US005124953A

United States Patent [19]

Grosso

[11] Patent Number: 5,124,953

[45] Date of Patent: Jun. 23, 1992

[54] ACOUSTIC DATA TRANSMISSION METHOD

[75] Inventor: Donald S. Grosso, West Hartford, Conn.

[73] Assignee: Teleco Oilfield Services Inc., Meriden, Conn.

[21] Appl. No.: 736,397

[22] Filed: Jul. 26, 1991

[51] Int. Cl.[5] ..... G01V 1/40

[52] U.S. Cl. ..... 367/82; 340/853.1

[58] Field of Search ..... 367/82, 81; 340/853, 340/856, 857

[56] References Cited

U.S. PATENT DOCUMENTS

| | | | |
|---|---|---|---|
| 4,293,937 | 10/1981 | Sharp et al. | 367/82 |
| 4,390,975 | 6/1983 | Shawhan | 367/82 |
| 4,562,559 | 12/1985 | Sharp et al. | 367/82 |
| 5,050,132 | 9/1991 | Duckworth | 367/82 |
| 5,056,067 | 10/1991 | Drumheller | 367/82 |

*Primary Examiner*—Ian J. Lobo

*Attorney, Agent, or Firm*—Fishman, Dionne & Cantor

[57] ABSTRACT

An apparatus and method for selecting a passband frequency for acoustically transmitting signals over a drillstring is presented. In accordance with the present invention, a series of electrical signals, each progressively increasing in frequency over a predetermined range, excite an acoustic transmitter producing an acoustic signal in the drillstring. The power spectral density of this signal is measured and correlated to a modeled power spectral density for the drillstring. A passband frequency having the strongest correlation ratio between the measured and modeled power spectral density is selected as the frequency for acoustical communication in the drillstring.

7 Claims, 3 Drawing Sheets

ACOUSTIC DATA TRANSMISSION METHOD

BACKGROUND OF THE INVENTION

This invention relates generally to a method for acoustically transmitting data along a drillstring, and more particularly to a method of enhancing acoustic data transmissions by identifying the frequency stop-bands of the drillstring locally, within the section housing the acoustic transmitter.

Deep wells of the type commonly used for petroleum or geothermal exploration are typically less than 30 cm (12 inches) in diameter and on the order of 2 km (1.5 miles) long. These wells are drilled using drillstrings assembled from relatively light sections (either 30 or 45 feet long) of drill pipe that are connected end-to-end by tool joints, additional sections being added to the uphole end as the hole deepens. The downhole end of the drillstring typically includes a drill collar, a dead weight assembled from sections of relatively heavy lengths of uniform diameter collar pipe having an overall length on the order of 300 meters (1000 feet). A drill bit is attached to the downhole end of the drill collar, the weight of the collar causing the bit to bite into the earth as the drillstring is rotated from the surface. Sometimes, downhole mud motors or turbines are used to turn the bit. Drilling mud or air is pumped from the surface to the drill bit through an axial hole in the drillstring. This fluid removes the cuttings from the hole, provides hydrostatic head which controls the formation gases, and sometimes provides cooling for the bit.

Communication between downhole sensors of parameters such as pressure or temperature and the surface has long been desirable. Various methods that have been tried for this communication include electromagnetic radiation through the ground formation, electrical transmission through an insulated conductor, pressure pulse propagation through the drilling mud, and acoustic wave propagation through the metal drillstring. Each of these methods has disadvantages associated with signal attenuation, ambient noise, high temperatures, and compatibility with standard drilling procedures. The most commercially successful of these methods has been the transmission of information by pressure pulse in the drilling mud (known as mud pulse telemetry). However, attenuation mechanisms in the mud limit the transmission rate to less than 3 bit per second.

Faster data transmission may be obtained by the use of acoustic wave propagation through the drillstring. While this method of data transmission has heretofore been regarded as impractical, a significantly improved method and apparatus for the acoustic transmission of data through a drillstring is disclosed in U.S. patent application Ser. No. 605,255 filed Oct. 29, 1990, which is a continuation-in-part of U.S. application Ser. No. 453,371 filed Dec. 22, 1989 (all of the contents of which are fully incorporated herein by reference) which will permit large scale commercial use of acoustic telemetry in the drilling of deep wells for petroleum and geothermal exploration.

U.S. Ser. No. 605,255 describes an acoustic transmission system which employs a transmitter for converting an electrical input signal into acoustic energy within the drill collar. The transmitter includes a pair of spaced transducers which are controlled by a digital circuit. This digital circuit controls phasing of electrical signals to and from the transducers so as to produce an acoustical signal which travels in only one direction.

In acoustic data transmissions along a segmented tubular structure such as a drill pipe used for drilling a well as described above, there exists both passband and stop-band frequency domains. The frequencies of these bands are determined by the material and dimensions of the tubular structure as well as the geometry of the segments. Data can be transmitted readily at the passband frequencies, but signals at the stop-band frequencies are rapidly attenuated and thus lost. Also, within the passbands there is a fine structure of low loss passbands interspersed with bands where very high attenuation occurs. These fine structure bands are described in some detail in an article entitled "Acoustical Properties of Drillstrings" by Douglas S. Drumheller, J. Acoust. Soc. Am 85 (3), pp. 1048–1064, March 1989. As described in the Drumheller paper, the fine structure bands are caused by the destructive interference of acoustic waves reflected from the ends of the tube with the original signal wave, when the two waves arrive at the receiver substantially out of phase. As a result of this fine structure phenomenon, the passband frequencies depend upon the overall length of the tube. This makes for difficulties in transmitting data when the overall length of the tube is changing, as in drilling operations where the depth of the well, and hence the length of the tube (drill pipe) is constantly increasing thereby shifting the fine structure bands. Because of the presence of this fine structure and the constantly changing nature of the fine structure, it is very difficult to determine the optimal transmission frequency and thereby accurately transmit acoustic data signals.

SUMMARY OF THE INVENTION

The above-discussed and other problems and deficiencies of the prior art are overcome or alleviated by the method of acoustically transmitting data signals of the present invention. In accordance with the present invention, a downhole acoustic transmitter transmits a series of signals through a range of frequencies (e.g., frequency sweep) and locally measures the power spectral density of the resulting acoustic energy. As a result, the stop-bands in the localized section of the transmitter can be identified and the passbands are then located between the local amplitude valleys of the stop-bands. The power spectral density of the drillstring is modeled, which is then correlated to the measured power spectral density. The passband frequency with the strongest correlation ratio (i.e., between the measured and modeled power spectral density) is selected for transmission of acoustic data signals. The modeled power spectral density can be weighted to eliminate passbands known to be troublesome under drilling conditions.

The above-discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
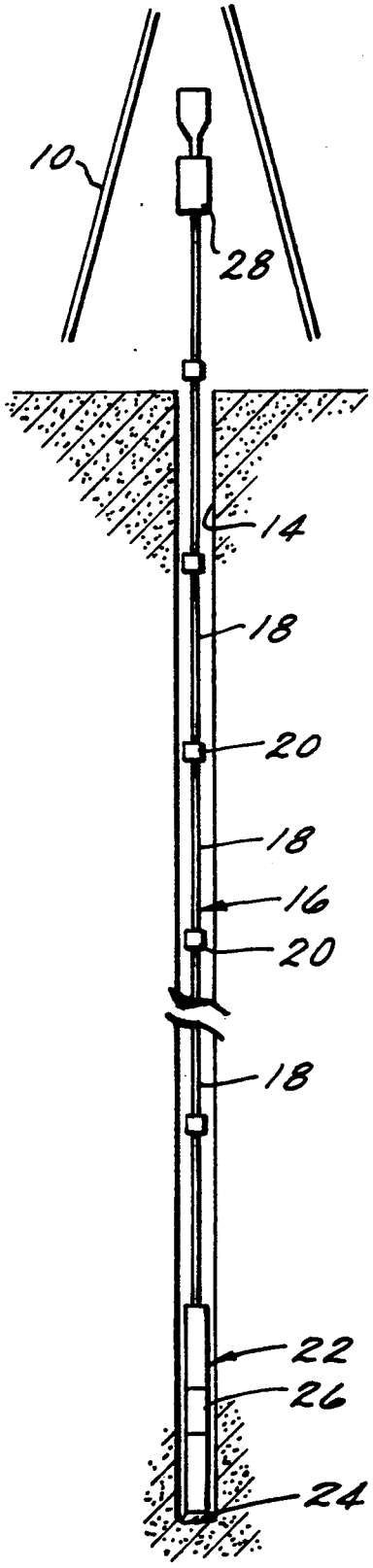
FIG. 1 is a cross-sectional elevation view depicting a downhole drilling apparatus and drillstring employing an acoustic signal transmission means in accordance with the present invention.

Referring first to FIG. 1, a schematic of a drillstring utilizing an acoustic telemetry system such as the type described in U.S. Ser. No. 605,255 is shown. In FIG. 1, a drilling rig 10 is positioned on the surface 12 above a borehole 14 which is traversed by a drillstring 16. Drillstring 16 is assembled from sections of drill pipe 18 that are connected end-to-end by tool joints 20. It will be appreciated that additional sections of drill pipe 18 are added to the uphole end of drillstring 16 as the hole deepens. The downhole end of the drillstring includes a drill collar 22 composed of drill collar pipe having a diameter which is relatively larger than the diameter of the drill pipe sections 18. Drill collar section 22 includes a bottom hole assembly which terminates at drill bit 24 and which may include several drill collar sections housing downhole sensors for sensing parameters such as pressure, position or temperature. In accordance with the present invention, one of the drill collar sections includes an acoustic transmitter 26 which communicates with an acoustic receiver 28 uphole of drillstring 16 by the transmission of acoustic signals through the drillstring. The acoustic transmitter 26 and receiver 28 are described in detail in U.S. Ser. No. 605,255, which has been fully incorporated herein by reference.

Figure 2:
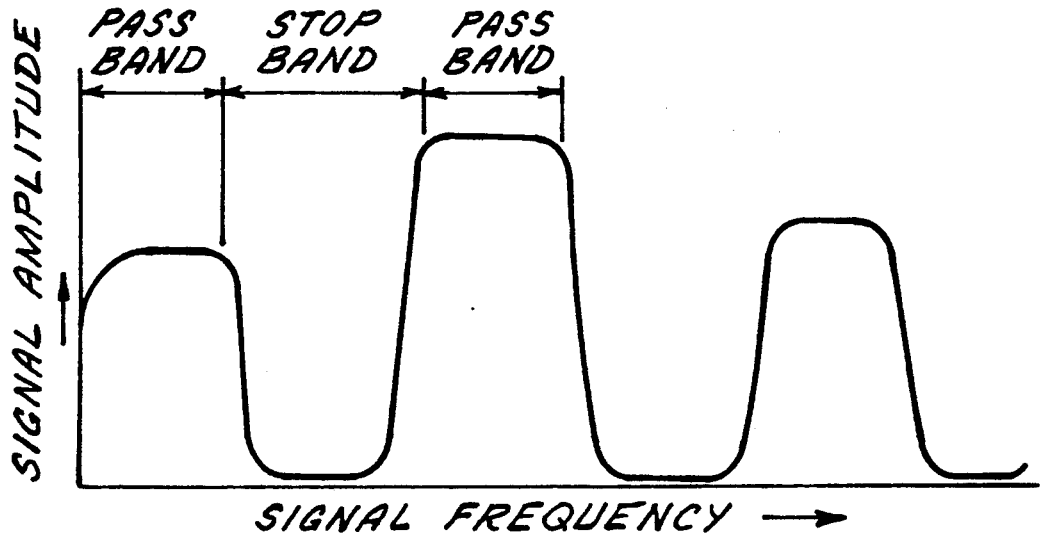
FIG. 2 is a graph of signal amplitude versus signal frequency in an acoustic transmission system depicting the several passbands and stop-bands for an initial characteristic of a received signal.
Figure 3:
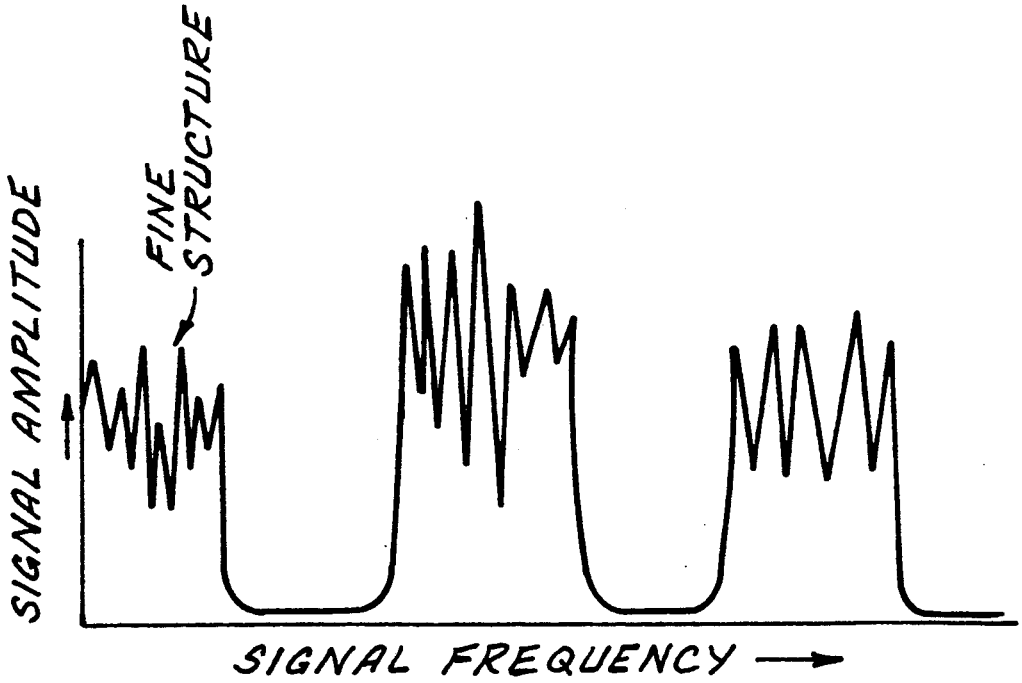
FIG. 3 is a graph similar to FIG. 2 depicting the stop-bands and passbands of later characteristics of the received signals wherein the "fine structure" appears.

Acoustic transmitter 26 transmits acoustic signals which travel along drillstring 16 at the local velocity of sound, that is, about 18,000 feet per second if the waves are longitudinal and 10,000 feet if they are torsional. As shown in FIG. 2, the initial characteristic of a signal received by receiver 28 which has been transmitted by acoustic transmitter 26 has a plurality of alternating passbands and stop-bands with respect to signal frequency. It will be appreciated that the frequency chosen by acoustic transmitter 26 should be one which is the high amplitude reception section of a passband. Unfortunately, the broad amplitude passbands of FIG. 2 do not remain with time. Instead, interfering signals resulting from the reflection of the original transmitted signal break up the broad passbands into what is termed "fine structure" shown in FIG. 3. FIG. 3 depicts the characteristics of the received signal subsequent to interference by reflected signals and therefore exhibiting the "fine structure". In order to transmit with such fine structure, the frequency must be carefully selected so as to coincide with a high amplitude peak of the fine structure. Of course, the frequency choice is thereby limited and difficult to achieve. Moreover, correct frequency choice becomes even more difficult as the fine structure changes as new drill pipe 18 is added.

Figure 4:
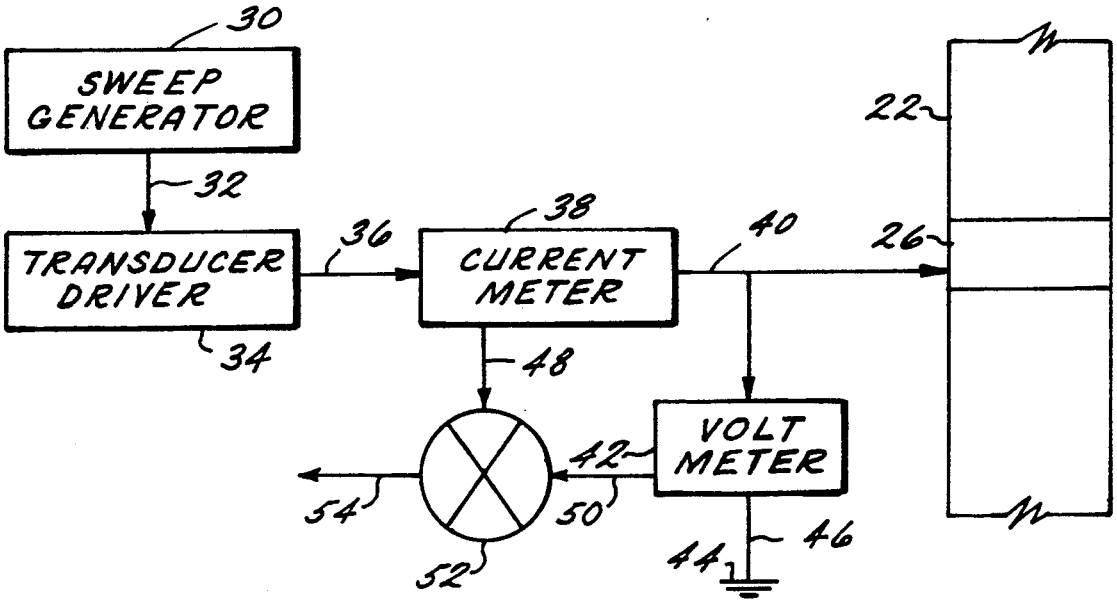
FIG. 4 is a schematic diagram of an apparatus for implementing the method of the present invention.

Referring now to FIG. 4, in a preferred embodiment of the present invention, a sweep generator 30 transmits a sweep signal over a line 32 to a transducer driver 34. The sweep signal is a series of sinusoidal signals, each advancing in frequency through a predetermined frequency range so as to sweep the range. This range is preferably 100 Hz to 10,000 Hz. Transducers driver 34 provides a transducer driver signal on a line 36 which is the sweep signal adapted to drive acoustic transmitter 26 at the frequencies of the sweep signal.

A current meter 38 is presented at line 36 to measure the current of the drive signal to acoustic transmitter 26. The drive signal is then presented to acoustic transmitter 26 by a line 40. A volt meter 42 is presented at line 40 to measure the voltage of the drive signal at acoustic transmitter 26. This voltage is referenced to a ground 44 by a line 46. Thus, the electrical power (i.e., voltage times current) to acoustic transmitter 26 may be calculated. The electrical power can be determined by multiplying the output signals of current meter 38 presented on a line 48 and volt meter 42 presented on line 50 at a multiplier 52. The power signal present on a line 54 is available across the swept frequency range, thereby providing a power spectral density signal. It will be appreciated that the impedance of transmitter 26 will vary with frequency due to the stop and pass bands of drillstring 16. It will also be appreciated that this impedance is detectable by measuring the voltage and current at the input of transmitter 26. The stop and pass bands are detected when the power is calculated over the frequency range to provide the power spectral density (i.e., power as a function of frequency) of drillstring 16.

Acoustic transmitter 26 thus generates an acoustic signal indicative of the drive signal which travels along drillstring 16. The frequency spectrum of this acoustic energy may be locally (i.e., within the section of drillstring 16 where transmitter 26 is located) determined by multiplying the voltage (across the frequency range measured by volt meter 42) by the current (across the frequency range measured by current meter 38) at each frequency of interest (such as at 10 Hz intervals) thus providing a power spectral density signal (i.e., power versus frequency) of drillstring 16. The stop-bands (FIG. 2) can be identified since the drillstring 16 selectively conducts transmitted energy. The energy in the stop-band frequencies will thus be locally trapped creating amplitude valleys. The passbands (FIG. 2) are located between the local amplitude valleys. Thus, in the preferred embodiment acoustic transmitter 26 can concentrate its energy into the passband or passbands where it will be most effective.

To determine the most effective passband(s) the Drumheller's model described in detail in the aforementioned article entitled "Acoustical Properties of Drillstrings" by Douglas S. Drumheller, J. Acoust. Soc. AM 85 (3), pp. 1048–1064, March 1989, is used.

The model is stored in a memory of a signal processing means located downhole (not shown). The measured voltage and current are also stored in the memory. A first predetermined algorithm is employed to calculate the measured power spectral density. This can be accomplished by using the Discrete Fourier Transform as follows:

The power spectral density (PSD) is defined as the Fourier Transform of the covariance function. The PSD can be written as:

$$S(f) = \int_{-\infty}^{\infty} C_x(\tau)e^{(-j2\pi f\tau)}d\tau$$

where $C_x(\tau)$ is the covariance function and is defined as:

$$C_x(\tau)=R_x(\tau)-m^2$$

$$C_x(\tau)=E\,[x(t)\,x(t+\tau)]-m^2$$

x(t) is the time domain signal

S(f) is the frequency representation of x m is the mean of x.

To compute the power spectral density digitally the Discrete Fourier Transform is used.

Let the input sequence $\{X(n), 0 \leqq n \leqq N-1\}$ be stationary with zero mean and with ensemble covariance function:

$$C(k)=R(k)=E\,[X(n)\,X(n+k)]$$

An estimate of the covariance function is given by the time average function as:

$$R_N(k) = \frac{1}{N} \sum_{j=0}^{N-|k|-1} X(j)X(j+|k|) \qquad |k| \leqq N$$

$$R_N(k) = 0 \qquad |k| > N$$

An estimate of the ensemble PSD is:

$$S(w) = \sum_{k=-\infty}^{\infty} R(k) \exp(-jwk)$$

$$-\pi \leqq w \leqq \pi$$
$$w = 2\pi f$$

The measured power spectral density is then compared to the Drumheller modeled power spectral density for drillstring 16 by a second predetermined algorithm to provide a correlation ratio of the two. This can be accomplished using the coherency function as follows:

To find the relation of the measured and modeled PSD's, the cross power spectrum is used to compute the transfer function and coherency as described in A. Oppenheim & R. Schafer, *Digital Signal Processing* 284–336, 376–403, 532–576 (1975). The cross power spectrum $G_{xy}$ is defined by taking the Fourier Transform of two signals separately and multiplying the result together as follows:

$$G_{xy}(f) = S_x(f)S_y^*(f)$$

where $$S_x(f) = \int_{-\infty}^{\infty} x(t)e^{-jwt}\,dt \qquad w = 2\pi f$$

*is defined as the complex conjugate.

The transfer function H(f) is defined as:

$$H(f)=G_{yx}(f)/G_{xx}(f)$$

denotes the average of the function:

The coherence function is defined as follows:

$$COH(f)=(G_{yx}(f)\,G_{xy}^*(f))/(G_{xx}(f)\,G_{yy}(f))$$

Generally, each passband frequency is less than ideal, as will be indicated by the correlation ratios in the predicted passbands. The model is typically weighted to eliminate passbands susceptible to drilling noise based on past history. The passband frequency(s), one or more, with the strongest correlation to the weighted Drumheller model (i.e., for drillstring 16) is/are selected as the desired frequency(s) to be employed for acoustic transmission through drillstring 16.

Thus, since the passbands frequencies are dependent on the overall length of drillstring 16, the preferred passband(s) for acoustic transmission will change as additional drill pipe 18 (FIG. 1) sections are added to drillstring 16. The present invention may periodically generate a frequency sweep signal so that the passband(s) with the strongest correlation is always selected. This allows for effective acoustic transmission through drillstring 16 at all stages of drilling. Further, although acoustic communication is described from downhole to the surface, it will be appreciated that communication may originate at the surface to be sent downhole, without departing from the spirit or scope of the present invention.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for selecting a passband frequency of a drillstring for acoustical communication therein, the drillstring having a plurality of drill pipe sections connected end-to-end by joints from a first location below the surface of the earth to a second location at or near the surface of the earth, the length and cross-sectional area of the drill pipe sections being different from the length and cross-sectional area of the joints, comprising:

sweep signal means for providing a sweep signal comprising a series of electrical signals through a predetermined frequency range, said predetermined frequency range including at least one passband of the drillstring;

acoustic transmitter means responsive to said sweep signal for generating an acoustic signal indicative of said sweep signal in the drillstring, said acoustic transmitter means disposed at either said first location or said second location;

power spectral density means for providing a power spectral density signal, said power spectral density signal indicative of the power of said sweep signal as a function of said frequency range; and signal processing means, responsive to said power spectral density signal, and having memory means for storing an executable algorithm for correlating a modeled power spectral density to said power spectral density signal, said modeled power spectral density being derived from mathematical model means stored in said memory means, said modeled power spectral density being indicative of the power spectral density of the drillstring, whereby at least one passband frequency of said power spectral density signal having a strong correlation to a corresponding passband frequency of said modeled power spectral density is selected for acoustical communication.

2. The apparatus of claim 1 wherein said power spectral density means comprises:

voltage means for providing a voltage signal as a function of said frequency range, said voltage signal indicative of the voltage of said sweep signal;

current means for providing a current signal as a function of said frequency range, said current signal indicative of the current of said sweep signal; and multiplying means for multiplying said voltage signal by said current signal to provide said power spectral density signal.

3. The apparatus of claim 1 wherein said series of electrical signals comprise:

a series of sinusoidal electrical signals, each sequentially advancing in frequency through said predetermined frequency range.

4. A method for selecting a passband frequency of a drillstring for acoustical communication therein, the drillstring having a plurality of drill pipe sections connected end-to-end by joints from a first location below the surface of the earth to a second location at or near the surface of the earth, the length and cross-sectional area of the drill pipe sections being different from the length and cross-sectional area of the joints, the method comprising the steps of:

(1) generating a series of electrical signals, each sequentially advancing in frequency through a predetermined frequency range, said predetermined frequency range including at least one passband of the drillstring, said series of electrical signals adapted to drive an acoustic transmitter;

(2) exciting said acoustic transmitter, said acoustic transmitter being responsive to said series of electrical signals, to produce an acoustic signal indicative of said series of electrical signals in the drillstring;

(3) measuring the power spectral density of said series of electrical signals to provide a power spectral density signal indicative of the power of said plurality of electrical signals as a function of said frequency range;

(4) modeling the power spectral density of the drillstring to provide a modeled power spectral density indicative thereof; and (5) correlating said power spectral density signal with said modeled power spectral density, whereby at least one passband frequency of said power spectral density signal having a strong correlation to a corresponding passband frequency of said modeled power spectral density is selected for acoustical communication.

5. The method of claim 4 wherein said measuring the power spectral density comprises:

measuring the voltage of said series of electrical signals to provide a voltage signal as a function of said frequency range;

measuring the current of said series of electrical signals to provide a current signal as a function of said frequency range; and multiplying said voltage signal by said current signal to provide said power spectral density signal.

6. The method of claim 4 wherein said series of electrical signals comprise:

a series of sinusoidal electrical signals.

7. The method of claim 4 including the step of:

repeating steps (1)–(5) continuously at a predetermined rate, to provide selection of a passband frequency with a strong correlation, as characteristics of the drillstring change.

* * * * *

UNITED STATES PATENT AND TRADEMARK OFFICE

CERTIFICATE OF CORRECTION

PATENT NO. : 5,124,953

DATED : June 23, 1992

INVENTOR(S) : Donald S. Grosso

It is certified that error appears in the above-indentified patent and that said Letters Patent is hereby corrected as shown below:

Col. 5, Line 15 Delete " $R_N(k)$ " and insert therefor – $\hat{R}_N(k)$ –.

Col. 5, Line 17 Delete " $R_N(k)$ " and insert therefor – $\hat{R}_N(k)$ –.

Col. 5, Line 22 Delete " $S(w)$ " and insert therefor – $\hat{S}(w)$ –.

Col. 5, Line 22 Delete " $R(k)$ " and insert therefor – $\hat{R}(k)$ –.

Col. 5, Line 50 Delete " $G_{yx}(f)/G_{xx}(f)$ " and insert therefor – $\overline{G_{yx}(f)/G_{xx}(f)}$ –.

Col. 5, Line 52 Insert "_____" prior to "denotes the average of the function".

Col. 5, Line 55 Delete " $COH(f)=(G_{yx}(f)\ G_{xy}.(f))/(G_{xx}(f)\ G_{yy}(f))$ " and insert therefor – $COH(f)=(\overline{G_{yx}}(f)\ \overline{G_{xy}}.(f))/(\overline{G_{xx}}(f)\ \overline{G_{yy}}(f))$ –.

Signed and Sealed this

Twenty-third Day of November, 1993

*Attest:*

*Attesting Officer*

BRUCE LEHMAN

*Commissioner of Patents and Trademarks*